US008895883B2

(12) United States Patent
Akesson

(10) Patent No.: US 8,895,883 B2
(45) Date of Patent: Nov. 25, 2014

(54) DUAL CURRENT PATH FOR HIGH RATED CURRENTS

(71) Applicant: Ulf Akesson, Ludvika (SE)

(72) Inventor: Ulf Akesson, Ludvika (SE)

(73) Assignee: ABB Technology AG (CH)

( * ) Notice: Subject to any disclaimer, the term of this patent is extended or adjusted under 35 U.S.C. 154(b) by 0 days.

(21) Appl. No.: 14/144,036

(22) Filed: Dec. 30, 2013

(65) Prior Publication Data

US 2014/0110235 A1 Apr. 24, 2014

Related U.S. Application Data

(63) Continuation of application No. PCT/EP2012/062457, filed on Jun. 27, 2012.

(30) Foreign Application Priority Data

Jun. 29, 2011 (EP) ..... 11171906

(51) Int. Cl.

| | |
|---|---|
| ***H01H 3/00*** | (2006.01) |
| ***H01H 33/02*** | (2006.01) |
| ***H01H 1/38*** | (2006.01) |
| *H01H 33/14* | (2006.01) |
| *H01H 33/91* | (2006.01) |

(52) U.S. Cl.

CPC ..... *H01H 33/02* (2013.01); *H01H 33/025* (2013.01); *H01H 1/385* (2013.01); *H01H 33/14* (2013.01); *H01H 33/91* (2013.01)

USPC ..... 218/118; 218/59; 218/123

(58) Field of Classification Search

USPC ..... 218/59–66, 123, 118

See application file for complete search history.

(56) References Cited

U.S. PATENT DOCUMENTS

| | | | | |
|---|---|---|---|---|
| 3,632,928 | A * | 1/1972 | Emmerich et al. | 218/123 |
| 3,702,911 | A * | 11/1972 | Schonhuber | 218/123 |
| 3,777,089 | A * | 12/1973 | Nitz | 218/136 |
| 3,953,693 | A * | 4/1976 | Pflanz | 218/118 |
| 6,872,907 | B2 * | 3/2005 | Claessens et al. | 218/66 |
| 7,041,928 | B2 * | 5/2006 | Nowakowski | 218/59 |
| 2006/0260678 | A1 | 11/2006 | Nagao et al. | |

FOREIGN PATENT DOCUMENTS

| | | | |
|---|---|---|---|
| EP | 0016983 | A1 | 10/1980 |
| WO | 9621234 | A1 | 7/1996 |

OTHER PUBLICATIONS

European Search Report Application No. EP 11 17 1906 Completed: Nov. 25, 2011; Mailing date: Dec. 2, 2011 5 pages.

International Preliminary Report on Patentability Application No. PCT/EP2012/062457 Completed: Oct. 9, 2013 17 pages.

(Continued)

*Primary Examiner* — Truc Nguyen

(74) *Attorney, Agent, or Firm* — St. Onge Steward Johnston & Reens LLC

(57) ABSTRACT

A circuit breaker is disclosed. The circuit breaker includes a first current path section and a second current path section. At least one of the first and second current path section includes a first current path section member and at least one second current path section member. The at least one second current path section member is arranged in spaced relation to a surface of the first current path section member. The at least one second current path section member is electrically coupled with the first current path section member via at least a first coupling surface portion of the surface of the first current path section member.

16 Claims, 5 Drawing Sheets

(56) References Cited

OTHER PUBLICATIONS

International Search Report and Written Opinion of the International Searching Authority Application No. PCT/EP2012/062457 Completed: Sep. 24, 2012; Mailing Date: Oct. 2, 2012 8 pages.

Written Opinion of the International Preliminary Examining Authority Application No. PCT/EP2012/062457 Mailing Date: Jun. 19, 2013 5 pages.

* cited by examiner

DUAL CURRENT PATH FOR HIGH RATED CURRENTS

FIELD OF THE INVENTION

The present invention generally relates to equipment used in electrical power transmission. Specifically, the present invention relates to a circuit breaker, which may be particularly suitable for high voltage electrical power transmission systems.

BACKGROUND OF THE INVENTION

Circuit breakers for interrupting an electrical circuit, i.e. discontinuing flow of electrical current in the electrical circuit, are known. Such circuit breakers are arranged in the respective electrical circuits which are intended to be interrupted based on some predefined event occurring in the electrical circuit. Generally, operation of such circuit breakers are responsive to detection of a fault condition or fault current. On detection of such a fault condition or fault current, a mechanism may operate the circuit breaker so as to interrupt the current flowing therethrough, thereby interrupting the current flowing in the electrical circuit. Typically, once a fault is detected, contacts within the circuit breaker separate in order to interrupt the electrical circuit. Often spring arrangements, pneumatic arrangements or some other means utilizing mechanically stored energy are employed to separate the contacts. Some of the energy required for separating the contacts may be obtained from the fault current itself. When interrupting the current flowing in the electrical circuit, an arc is generally generated. This arc must be cooled so that it becomes quenched or extinguished, such that the gap between the contacts repeatedly can withstand the voltage in the electrical circuit. It is known to use vacuum, air, oil or insulating gas as medium in which the arc forms. Insulating gas comprises for example sulphur hexafluoride, $SF_6$, gas. Once the fault condition has been mitigated or eliminated the contacts are closed, whereby flow of current in the electrical circuit can be resumed.

The circuit breaker contacts should be able to carry the load current without excessive heating. Also, the circuit breaker contacts should be capable of withstanding heat of the arc that is produced when the electrical circuit is interrupted. Contacts are for example made of metals or metal alloys such as Cu or Ag or alloys containing Cu and/or Ag. The cooling and/or extinguishing or the arc may take place in a component of the circuit breaker often referred to as a puffer-type cylinder or selfblast chamber. Such a puffer-type cylinder is typically connected to the electrical circuit at two ends via respective current path sections, often referred to as the upper and lower current paths or current path sections. In general, the maximum possible continuous rated current for a circuit breaker is limited by the choice of material in the current carrying parts in the circuit breaker.

There is an ever increasing demand for circuit breakers having higher maximum continuous rated current.

In order to increase the maximum possible rated continuous current for a circuit breaker, it has been proposed to increase the cross section of current path sections so as to obtain a decrease in the resistance of the current path sections. However, by the arrangement of the current paths sections relatively to the puffer-type cylinder, such a solution may require increasing the diameter of the puffer-type cylinder. Hence, such a solution may entail relatively high costs.

It has also been proposed to equip the circuit breaker with an additional puffer-type cylinder arranged in parallel to the existing puffer-type cylinder in order to achieve a larger surface via which cooling can be effected.

Hence, proposed solutions may entail substantial modification of existing equipment. It would be desirable to be able to increase the maximum possible rated continuous current for a circuit breaker while requiring only relatively small modification of existing equipment.

SUMMARY OF THE INVENTION

In view of the above discussion, an object of the present invention is to provide a circuit breaker capable of an increased maximum possible rated continuous current.

Another object of the present invention is to provide a circuit breaker capable of an increased maximum possible rated continuous current while requiring only relatively small modification of existing equipment.

To address one or more of these objects and other objects, a circuit breaker is provided. Preferred embodiments are defined herein.

According to a first aspect of the present invention, there is provided a circuit breaker connectable to an electrical circuit. The circuit breaker comprises a first current path section and a second current path section.

According to a first aspect of the present invention, there is provided a circuit breaker connectable to an electrical circuit. The circuit breaker comprises a first current path section and a second current path section. Each of the first and second current path section comprises a respective first end and a respective second end. Each of the first and second current path section is connectable to the electrical circuit at the respective first end.

The circuit breaker comprises a circuit breaker module adapted to at least momentarily controllably discontinue flow of electrical current in the electrical circuit, by at least momentarily controllably discontinuing flow of electrical current through the circuit breaker module.

Each of the first and second current path section is connectable to the circuit breaker module at the respective second end.

At least one of the first and second current path section comprises a first current path section member and at least one second current path section member. The at least one second current path section member is arranged in spaced relation to a surface of the first current path section member. The at least one second current path section member is electrically coupled with the first current path section member via at least a first coupling surface portion of the surface of the first current path section member.

One gist of the present invention is to provide a current path section arrangement that has an increased surface area available for cooling of the current path section, e.g. by means of convection, and a decreased resistance compared to e.g. a circuit breaker comprising a circuit breaker module for effectuating interruption of the current and a current path section comprising a single member connecting the circuit breaker module to the electrical circuit.

In contrast to a current path section comprising a single member, the current path section arrangement according to the present invention includes two or more current path section members arranged relatively to each other so as to be able to increase the cooling surface and decrease resistance of the overall current path section arrangement. This is achieved by the at least one second current path section member being arranged in spaced relation to a surface of the first current path section member, which at least one second current path section member is electrically coupled with the first current path section member via at least a first coupling surface portion of the surface of the first current path section member. By the at least one second current path section member being arranged in spaced relation to a surface of the first current path section member, the surface available for cooling of the overall current path section arrangement may be increased. By the electrical coupling between the at least one second current path section member with the first current path section member, the resistance of the overall current path section arrangement may be decreased. Thereby, a higher maximum possible rated continuous current may be achieved compared to e.g. a circuit breaker comprising a circuit breaker module for effectuating interruption of the current and a current path section comprising a single member connecting the circuit breaker module to the electrical circuit.

A spacing between the at least one second current path section member and a surface of the first current path section member may typically be a few millimeters or centimeters. The spacing is preferably such so as to allow for or enable convection taking place in the gap between the first current path member and the at least one second current path member.

The circuit breaker module may comprise one or more components such as, but not limited to, electrical contacts, possibly movable, a so called puffer-type cylinder, a so called selfblast chamber, a pressure collecting space, a compression space, or puffer volume, and an expansion space. The circuit breaker module may effectuate interruption of the electrical circuit by means of one or more of such components, thereby discontinuing flow of electrical current in the electrical circuit, and/or extinction of the arc produced when the electrical circuit is interrupted.

Interruption of the electrical circuit and/or extinction of the arc produced when the electrical circuit is interrupted may for example be carried out in a manner similar to or the same as disclosed in WO96/21234A1.

As mentioned above, the at least one second current path section member is electrically coupled with the first current path section member via at least a first coupling surface portion of the surface of the first current path section member, i.e. via at least one coupling surface portion, or coupling point, on the surface of the first current path section member. Hence, a coupling surface portion may comprise a single point on the surface.

However, the at least one second current path section member may be electrically coupled with the first current path section member via a plurality of different coupling surface portions, or points, of the surface of the first current path section member. This may further increase the resistance of the overall current path section arrangement.

For example, the at least one second current path section member may be electrically coupled with the first current path section member further via at least a second coupling surface portion of the surface of the first current path section member, wherein the first coupling surface portion is situated at the first end of the respective one of the first and second current path section and the second coupling surface portion is situated at the second end of the respective one of the first and second current path section, or vice versa.

Each of the first current path section and a second current path section, and each of the first current path section member and the at least one second current path section member, may be made of appropriate conductive material, for example metals such as Cu and/or Al, or alloys comprising Cu and/or Al. This list is not exhaustive.

Electrical coupling between the at least one second current path section member and the first current path section member via at least a first coupling surface portion may be effectuated for example by welding a portion of the at least one second current path section member to the first current path section member, or vice versa, at the at least a first coupling surface portion. However, other methods for effectuating the electrical coupling as known to a skilled person may be used.

According to a first example, the circuit breaker module comprises an axially movable hollow body within which one of the first and second current path section is coaxially arranged with respect to the hollow body. The above-mentioned one of the first and second current path section may comprise a first current path section member and at least one second current path section member, arranged in spaced relation to an inner surface of the first current path section member, and being electrically coupled with the first current path section member via at least a first coupling surface portion of the inner surface of the first current path section member.

Hence, the at least one second current path section member may be arranged in spaced relation to an inner surface of the first current path section member. The at least one second current path section member may be electrically coupled with the first current path section member via at least a first coupling surface portion of the inner surface of the first current path section member.

The hollow body may for example comprise a hollow cylinder, e.g. a puffer-type cylinder.

According to a second example, one of the first and second current path section comprises a hollow body, and the circuit breaker module comprises an axially movable body arranged within the hollow body of the above-mentioned one of the first and second current path section, the axially movable body being coaxially arranged with respect to the hollow body of the above-mentioned one of the first and second current path section. The above-mentioned one of the first and second current path section may comprise a first current path section member and at least one second current path section member, arranged in spaced relation to an outer surface of the first current path section member and being electrically coupled with the first current path section member via at least a first coupling surface portion of the outer surface of the first current path section member.

Hence, the at least one second current path section member may be arranged in spaced relation to an outer surface of the first current path section member. The at least one second current path section member may be electrically coupled with the first current path section member via at least a first coupling surface portion of the outer surface of the first current path section member.

The axially movable body may for example comprise an axially movable cylinder, e.g. a puffer-type cylinder.

Hence, the circuit breaker module may for example comprise a puffer-type cylinder, where either one of the first and second current path sections is arranged within the puffer-type cylinder, in accordance with the above-mentioned first example, or the puffer-type cylinder is arranged within one of the first and second current path sections, in accordance with the above-mentioned second example.

For configurations in accordance with both of the above-mentioned first and second examples, the current path section arrangement according to the present invention may be provided without substantial modification of the circuit breaker module. For example, the need for increasing the diameter of the puffer-type cylinder for accommodating additional current path section(s) of the current path section arrangement according to the present invention may be mitigated or even avoided.

Each of the first current path section member and the at least one second current path member may for example comprise a tubular or cylindrical hollow body concentrically arranged with respect to each other.

For example, each of the first current path section member and the at least one second current path member may comprise a metal tube, the metal tubes having different diameters and being concentrically arranged with respect to each other. The metal tubes may be joined together in both of the respective ends, e.g. by means of welding, so as to provide electrical connection therebetween.

The thickness of such a metal tube may typically be a few millimeters or centimeters, although smaller or larger thicknesses are possible.

At least one of the first current path section member and the at least one second current path member may comprise at least one of an undulating surface, a plurality of fins and a plurality of protrusions.

Each of such configurations may provide an even further increase in surface area available for cooling, e.g. by means of natural or forced convection. In turn, the maximum possible rated continuous current may be increased even further.

In the context of the present application, by an undulating surface it is meant a surface having a wavy structure and/or appearance.

In the context of the present application, by a fin it is meant a projecting rib or the like on an element, or a surface which extends from an element, which increases the surface area of the element.

Each of the first current path section and the at least one second current path section may extend along a longitudinal direction. At least one of the first current path section member and the at least one second current path member may comprise a plurality of elongated bodies extending along the longitudinal direction.

The elongated bodies may for example comprise strips and/or rods or similar elements.

The plurality of elongated bodies may be circumferentially spaced about a boundary of the second end of the respective one of the first and second current path section.

At least one of the first current path section member and the at least one second current path member may comprise a plurality of through-holes.

The through-holes may for example comprise bores, i.e. possibly cylindrical hollow parts of the respective current path section member.

The through-holes may be arranged in the respective at least one of the first current path section member and the at least one second current path member such that the through-holes are distributed substantially evenly on the respective at least one of the first current path section member and the at least one second current path member, or according to some other suitable distribution.

Hence, at least one of the first current path section member and the at least one second current path member may be provided with venting holes which may facilitate or even enable natural or forced convection to take place, thereby allowing or enabling heat generated in the respective current path section member to be transferred from the respective current path section member to its surroundings, e.g. to the surroundings of the circuit breaker. In turn, this may increase cooling of the respective current path section member, thereby possibly increasing the maximum possible rated continuous current of the circuit breaker.

For example where at least one of the first current path section member and the at least one second current path member comprises a plurality of through-holes, natural or forced convection may take place in the spacing between the first current path member and the at least one second current path member.

Such through-holes may typically have a diameter of about 10-15 mm, although smaller or larger diameters are possible.

For example, the number of through-holes, the diameters of the respective through-holes and/or the distribution of through-holes on the respective at least one of the first current path section member and the at least one second current path member may be such so as to partially or even completely meet a desired cooling requirement, e.g. a cooling requirement which has been set on the basis of the desired maximum possible rated continuous current of the circuit breaker.

According to a second aspect of the present invention, there is provided switchgear comprising a circuit breaker according to the present invention.

According to a third aspect of the present invention, there is provided an electrical power transmission system comprising an electrical circuit to which a circuit breaker according to the present invention is connected.

The electrical power transmission system may be a high voltage electrical power transmission system. Thus, the circuit breaker according to the present invention may be adapted to operate in high voltage electrical circuits.

In the context of the present application, particularly with respect to electrical power transmission applications, by "high voltage" it is generally meant voltages exceeding 35 kV. However, the circuit breaker according to the present invention may be adapted to operate in electrical circuits where the voltage is equal to or less than 35 kV.

The circuit breaker according to the present invention may be adapted to operate in electrical circuits where the voltage is larger than 10 kV, or larger than 15 kV.

The respective one of the first and second current path section may further comprise at least one third current path section member arranged in spaced relation to a surface of the at least one second current path section member and being electrically coupled with the at least one second current path section member via at least a first coupling surface portion of the surface of the at least one second current path section member.

By such a configuration the available surface for cooling, e.g. by means of convection, and the resistance of the overall current path section arrangement may be further increased and decreased, respectively.

In the context of the present application, the term connected or coupled, or electrically connected or coupled, is not limited to be construed as directly connected, or directly electrically connected, but also encompasses functional connections having intermediate components. For example, on one hand, if an output of a first component is connected to an input of a second component, this comprises a direct connection. On the other hand, if an electrical conductor directly supplies an electrical signal from the output of the first component substantially unchanged to the input of the second component, alternatively via one or more additional components, the first and second component are also connected. However, the connection is functional in the sense that a gradual or sudden change in the electrical signal from the output of the first component results in a corresponding or modified change in the signal that is input to the second component.

Further objects and advantages of the present invention are described in the following by means of exemplifying embodiments.

It is noted that the present invention relates to all possible combinations of features recited herein. Further features of, and advantages with, the present invention will become apparent when studying the following description. Those skilled in the art realize that different features of the present invention can be combined to create embodiments other than those described in the following.

BRIEF DESCRIPTION OF THE DRAWINGS

Exemplifying embodiments of the invention will be described below with reference to the accompanying drawings, in which.

DETAILED DESCRIPTION OF THE INVENTION

The present invention will now be described more fully hereinafter with reference to the accompanying drawings, in which exemplifying embodiments of the present invention are shown. The present invention may, however, be embodied in many different forms and should not be construed as limited to the embodiments set forth herein; rather, these embodiments are provided by way of example so that this disclosure will convey the scope of the present invention to those skilled in the art. Furthermore, like numbers refer to like or similar elements or components throughout.

Figure 1:
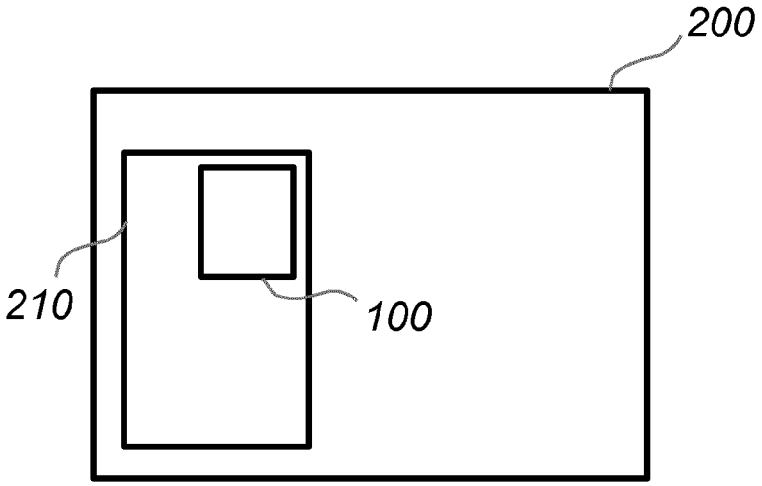
FIG. 1 is a schematic block diagram of an electrical power transmission system according to an exemplifying embodiment of the present invention.

Referring now to FIG. 1, there is shown a schematic block diagram of an electrical power transmission system 200 according to an exemplifying embodiment of the present invention. The electrical power transmission system 200 comprises an electrical circuit 210 to which a circuit breaker 100 according to an embodiment of the present invention is connected.

Figure 2:
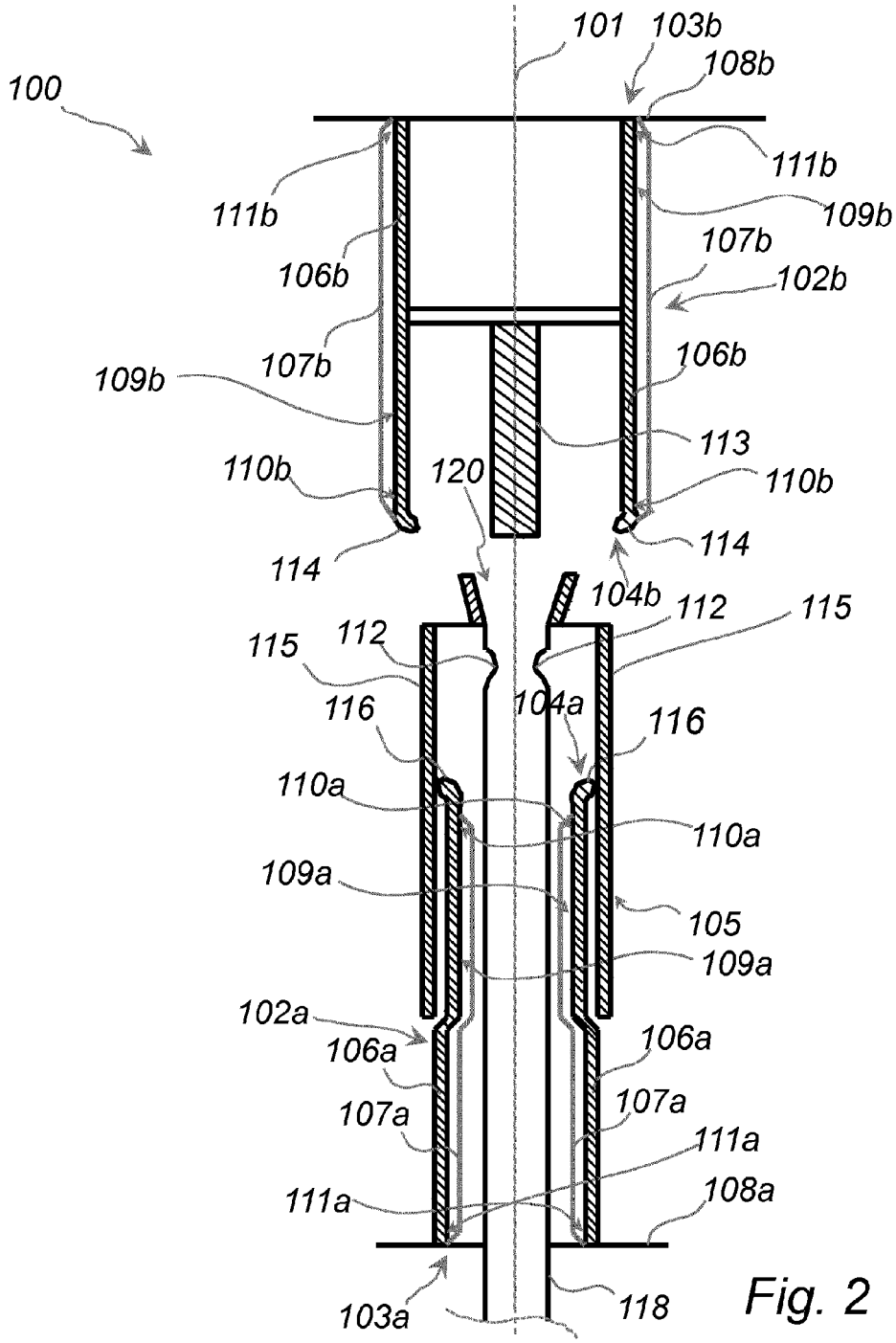
FIGS. 2 and 3 are schematic cross-sectional views of circuit breakers according to an exemplifying embodiment of the present invention.

Referring now to FIG. 2, there is shown a schematic cross-sectional view of a circuit breaker 100 according to an exemplifying embodiment of the present invention. FIG. 2 shows a cross-sectional view of the circuit breaker 100 along a direction perpendicular to the axial or longitudinal direction 101 of the circuit breaker 100.

The circuit breaker 100 comprises a first current path section 102*a* and a second current path section 102*b*.

The first current path section 102*a* comprises a first end 103*a* and a second end 104*a*. The first end 103*a* of the first current path section 102*a* is connected to an electrical circuit (not shown in FIG. 2, see FIG. 1) via a first connection flange 108*a*.

The second current path section 102*b* comprises a first end 103*b* and a second end 104*b*. The first end 103*b* of the first current path section 102*b* is connected to the electrical circuit via a second connection flange 108*b*.

The circuit breaker 100 comprises a circuit breaker module 105 adapted to at least momentarily controllably discontinue flow of electrical current in the electrical circuit by at least momentarily controllably discontinuing flow of electrical current through the circuit breaker module 105. This will be described in further detail in the following.

Each of the first and second current path section 102*a*, 102*b* is connectable to the circuit breaker module 105 at the respective second end 104*a*, 104*b*.

According to the depicted embodiment, the first current path section 102*a* comprises a first current path section member 106*a* and a second current path section member 107*a*. The second current path section member 107*a* is arranged in spaced relation to a surface 109*a* of the first current path section member 106*a* and is electrically coupled with the first current path section member 106*a* separately via a first coupling surface portion 110*a* and a second coupling surface 111*a* of the surface 109*a*.

According to the depicted embodiment, the second current path section 102*b* comprises a first current path section member 106*b* and a second current path section member 107*b*. The second current path section member 107*b* is arranged in spaced relation to a surface 109*b* of the first current path section member 106*b* and is electrically coupled with the first current path section member 106*b* separately via a first coupling surface portion 110*b* and a second coupling surface 111*b* of the surface 109*b*.

While according to the embodiment depicted in FIG. 2 each of the second current path section members 107*a*, 107*b* is electrically coupled with the respective first current path section member 106*a*, 106*b* via two different coupling surfaces 110*a*, 110*b*, 111*a*, 111*b*, each of the second current path section members 107*a*, 107*b* may be electrically coupled with the respective first current path section member 106*a*, 106*b* via one coupling surface 110*a*, 110*b* only. An example of such an arrangement is depicted in FIG. 3.

Figure 3:
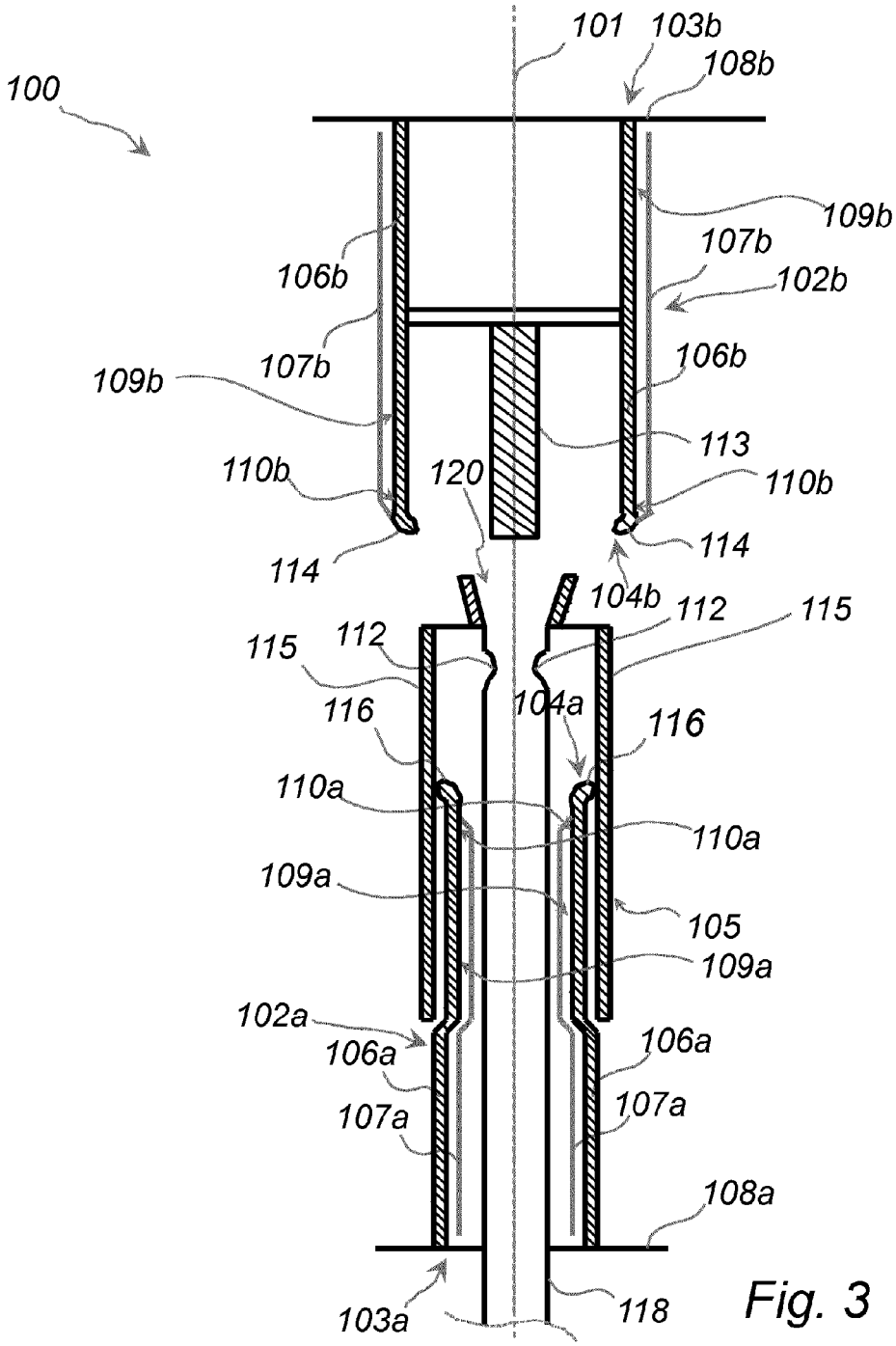

As indicated in FIGS. 2 and 3, FIGS. 2 and 3 show axial sections of, amongst others, the first current path section member 106*a* of the first current path section 102*a* and of the first current path section member 106*b* of the second current path section 102*b*.

As indicated in FIGS. 2 and 3, the thickness of the first current path section member 106*a*, 106*b* may be larger than the thickness of the second current path section member 107*a*, 107*b*. However, according to other examples the thickness of the first current path section member 106*a*, 106*b* may be the same or smaller than the thickness of the second current path section member 107*a*, 107*b*.

With further reference to FIGS. 2 and 3, operation of the circuit breaker 100 will now be described. Operation of the circuit breaker 100 may be similar to operation of the circuit breaker disclosed in WO96/21234A1.

The circuit breaker 100 includes an elongated casing (not shown in FIGS. 2 and 3) made of an insulating material housing the components shown in FIGS. 2 and 3, respectively, arranged between the first and second connection flanges 108*a*, 108*b*. The casing includes the first and second connection flanges 108*a* and 108*b*. Within the casing there is insulating gas, for example $SF_6$.

According to the depicted embodiment, the circuit breaker module 105 comprises a puffer-type cylinder which is axially movable along the axial direction 101 of the circuit breaker 100.

The circuit breaker module 105 comprises an arcing contact 112 and a main contact 115.

The second current path section 102*b* comprises an arcing contact 113 which cooperates with the arcing contact 112 of the circuit breaker module 105.

The second end 104*b* of the second current path section 102*b* comprises a portion which is configured so as to form a plurality of contact fingers constituting a fixed main contact 114 of the circuit breaker 100. For example where the second current path section comprises a tube or the like in accordance with the depicted embodiment, one end of the tube may be compression-moulded and slotted so as to form the plurality of contact fingers. Other arrangements of the main contact 114 are possible.

The first current path section 102*a* comprises sliding contact means 116, for example comprising spiral springs or the like, electrically connecting the circuit breaker module 105 and the first current path section 102*a*.

Alternatively or optionally, the sliding contact means 116 may be entities separate from the first current path section 102*a*.

The circuit breaker module 105 is connected via an operating rod 118 to an operating device (not shown in FIGS. 2 and 3). The operating device is configured to axially displace the circuit breaker module 105 by means of the operating rod 118 between a closed position, where the electrical circuit is closed, and an open position, where the electrical circuit is interrupted. The open position is shown in FIGS. 2 and 3. The operating device may be adapted to axially displace the circuit breaker module 105 from the closed position to the open position responsive to detection of a fault condition or fault current in the electrical circuit.

During operation of the circuit breaker 100, the circuit breaker module 105 is axially displaced along the axial direction 101 away from the second current path section 102*b* by means of the operating rod 118, whereby the main contacts 114 and 115 become separated. The current thereby transmits or commutes over the arcing contacts 112 and 113. When the arcing contacts 112 and 113 become separated, an arc is generated between them.

As illustrated in FIGS. 2 and 3, during axial displacement of the circuit breaker module 105 along the axial direction 101 away from the second current path section 102*b*, the main contacts 114 and 115 first become separated, and then after further axial displacement of the circuit breaker module 105 along the axial direction 101 away from the second current path section 102*b*, the arcing contacts 112 and 113 become separated. In this manner, the main contacts 114 and 115, which hence open before the arcing contacts 112 and 113, are not affected by an arc when separated.

When the circuit breaker module 105 is axially displaced along the axial direction 101 away from the second current path section 102*b*, the insulating gas enclosed in the puffer-type cylinder is compressed and forced past the arcing contact 112 and through a nozzle 120. When the arcing contacts 112 and 113 become separated, an arc is generated between them.

The arc current generally follows a power-frequency sine curve, and when the value of the current approaches the zero crossing, the insulating gas starts to flow out of the puffer-type cylinder through the nozzle 120. By means of the flow of insulating gas the arc is cooled. Then, when the value of the current approaches the next zero crossing, the arc is extinguished. Thereby, the current through the electrical circuit becomes interrupted.

Subsequently, e.g. once the fault condition or fault current in the electrical circuit has been cleared, the circuit breaker module 105 is axially displaced along the axial direction 101 towards the second current path section 102*b* by means of the operating rod 118, whereby first the arcing contacts 112, 113 engage and then the main contacts 114 and 115 engage. This causes flow of electrical current in the electrical circuit to resume.

The puffer-type cylinder may subsequently be refilled with insulating gas. For example, insulating gas may be supplied to the casing enclosure.

FIGS. 2 and 3 refer to embodiments where the circuit breaker module 105 comprises a puffer-type cylinder. That is, FIGS. 2 and 3 refer to puffer-type or selfblast type circuit breakers. However, it is to be understood that the present invention may be applicable to all types of circuit breakers utilizing insulating gas, such as $SF_6$ gas, for extinguishing the arc generated when the current in the electrical circuit is interrupted. For example, it is contemplated that the present invention is applicable to e.g. thermal blast chamber type circuit breakers.

Figure 4:
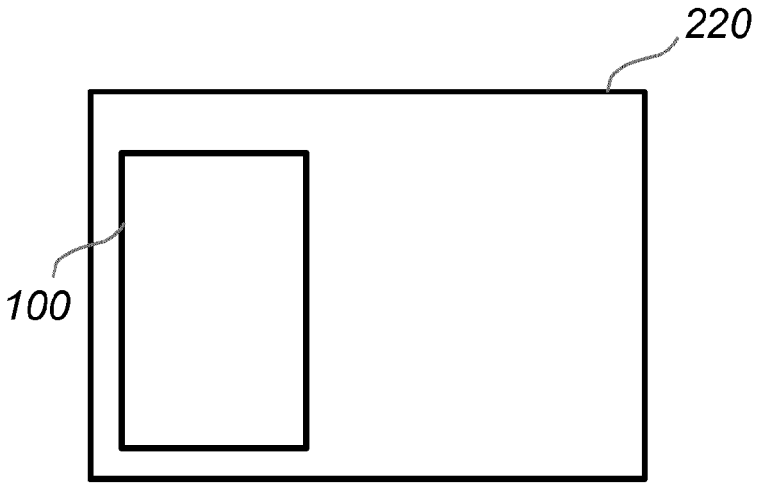
FIG. 4 is a schematic block diagram of switchgear according to an exemplifying embodiment of the present invention.

Referring now to FIG. 4, there is shown a schematic block diagram of switchgear 220 comprising a circuit breaker 100 according to an embodiment of the present invention.

Referring now to FIGS. 5-8, there are shown schematic cross-sectional views of a current path section 102*a* in a circuit breaker according to respective exemplifying embodiments of the present invention. Components of the circuit breaker other than the current section path 102*a* are not shown in FIGS. 5-8. Each of FIGS. 5-8 shows a cross-sectional view of the current path section 102*a* along a direction perpendicular to the axial or longitudinal direction 101 of the circuit breaker.

Figure 5:
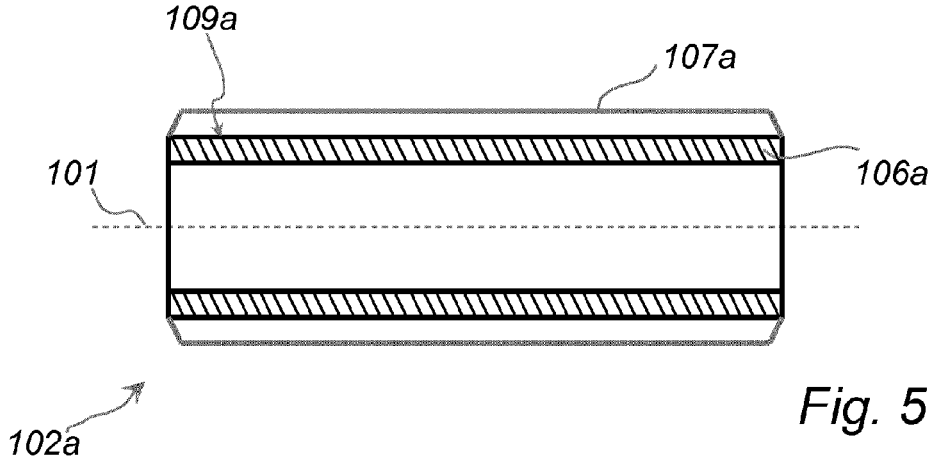
FIGS. 5-8 are schematic cross-sectional views of current path sections in accordance with exemplifying embodiments of the present invention.

Referring now to FIG. 5, the current path section 102*a* comprises a first current path section member 106*a* and a second current path section member 107*a* arranged in spaced relation to a surface 109*a* of the first current path section member 106*a* and being electrically coupled with the first current path section member 106*a* via two different coupling surface portions of the surface 109*a*. According to the depicted embodiment, each of the first current path section member 106*a* and the second current path section member 107*a* comprises a cylindrical hollow body concentrically arranged with respect to each other.

Figure 6:
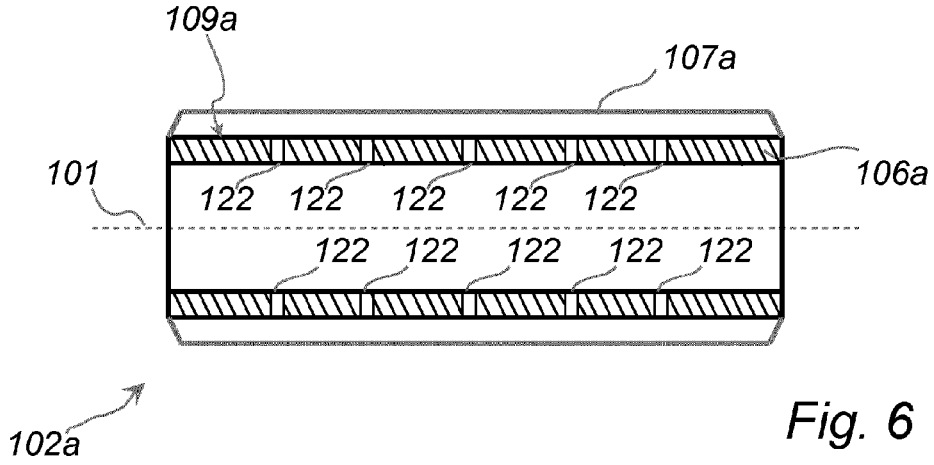

Referring now to FIG. 6, the first current path section member 106*a* comprises a plurality of through-holes 122.

Alternatively or optionally, the second current path section member 107*a* may comprise a plurality of through-holes (not shown in FIG. 6).

Figure 7:
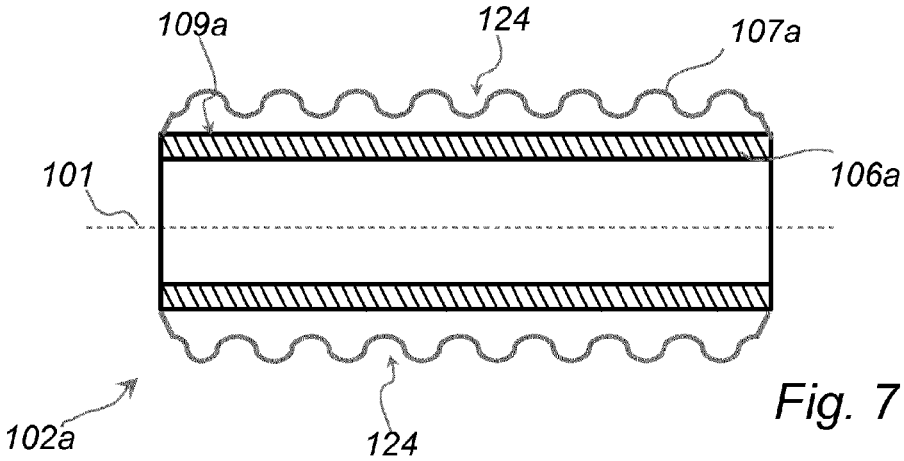

Referring now to FIG. 7, the second current path section member 107*a* comprises a undulating surface 124.

Figure 8:
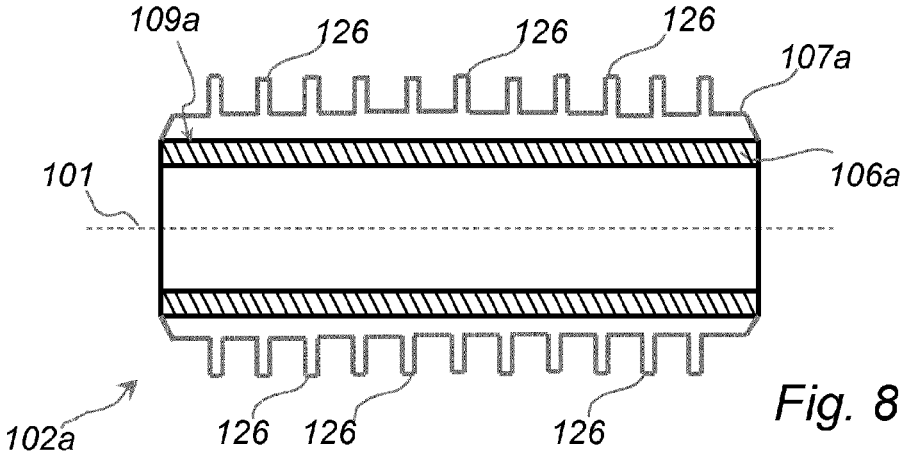

Referring now to FIG. 8, the second current path section member 107*a* comprises a plurality of protrusions 126. Only a few of the protrusions 126 are indicated by reference numerals in FIG. 8.

In conclusion, there is disclosed a circuit breaker comprising a first current path section and a second current path section. At least one of the first and second current path section comprises a first current path section member and at least one second current path section member. The at least one second current path section member is arranged in spaced relation to a surface of the first current path section member. The at least one second current path section member is electrically coupled with the first current path section member via at least a first coupling surface portion of the surface of the first current path section member.

While the present invention has been illustrated and described in detail in the appended drawings and the foregoing description, such illustration and description are to be considered illustrative or exemplifying and not restrictive; the present invention is not limited to the disclosed embodiments. Other variations to the disclosed embodiments can be understood and effected by those skilled in the art in practicing the claimed invention, from a study of the drawings, the disclosure, and the appended claims. The mere fact that certain measures are recited does not indicate that a combination of these measured cannot be used to advantage. Any reference signs in the claims should not be construed as limiting the scope.

What is claimed is:

1. A circuit breaker connectable to an electrical circuit, the circuit breaker comprising:

a first current path section and a second current path section, each of the first and second current path section comprising a respective first end and a respective second end, each of the first and second current path section being connectable to the electrical circuit at the respective first end; and a circuit breaker module adapted to at least momentarily controllably discontinue flow of electrical current in the electrical circuit by at least momentarily controllably discontinuing flow of electrical current through the circuit breaker module, each of the first and second current path section being connectable to the circuit breaker module at the respective second end;

wherein each of the first and second current path section comprises:

a first current path section member; and at least one second current path section member arranged in spaced relation to a surface of the first current path section member and being electrically coupled with the first current path section member via at least a first coupling surface portion of said surface of the first current path section member;

wherein the circuit breaker module comprises an axially movable hollow body within which one of the first and second current path section is coaxially arranged with respect to the hollow body, said one of the first and second current path section comprising a first current path section member and at least one second current path section member arranged in spaced relation to an inner surface of the first current path section member and being electrically coupled with the first current path section member via at least a first coupling surface portion of said inner surface of the first current path section member.

2. An electrical power transmission system comprising an electrical circuit to which a circuit breaker according to claim 1 is connected.

3. The circuit breaker according to claim 1 further comprising a switchgear to which the circuit breaker is connected.

4. The circuit breaker according to claim 1 further comprising a switchgear to which the circuit breaker is connected.

5. The circuit breaker according to claim 1 further comprising an electrical power transmission system comprising an electrical circuit to which a circuit breaker is connected.

6. The circuit breaker according to claim 1, wherein the at least one second current path section member is electrically coupled with the first current path section member further via at least a second coupling surface portion of said surface of the first current path section member, wherein the first coupling surface portion is situated at the first end of the respective one of the first and second current path section and the second coupling surface portion is situated at the second end of the respective one of the first and second current path section, or vice versa.

7. The circuit breaker according to claim 1, wherein each of the first current path section member and the at least one second current path member comprises a tubular or cylindrical hollow body concentrically arranged with respect to each other.

8. The circuit breaker according to claim 1, wherein at least one of the first current path section member and the at least one second current path member comprises at least one of an undulating surface, a plurality of fins and a plurality of protrusions.

9. A circuit breaker connectable to an electrical circuit, the circuit breaker comprising:

a first current path section and a second current path section, each of the first and second current path section comprising a respective first end and a respective second end, each of the first and second current path section being connectable to the electrical circuit at the respective first end; and a circuit breaker module adapted to at least momentarily controllably discontinue flow of electrical current in the electrical circuit by at least momentarily controllably discontinuing flow of electrical current through the circuit breaker module, each of the first and second current path section being connectable to the circuit breaker module at the respective second end;

wherein each of the first and second current path section comprises:

a first current path section member; and at least one second current path section member arranged in spaced relation to a surface of the first current path section member and being electrically coupled with the first current path section member via at least a first coupling surface portion of said surface of the first current path section member;

wherein one of the first and second current path section comprises a hollow body, and wherein the circuit breaker module comprises an axially movable body arranged within the hollow body of said one of the first and second current path section, the axially movable body being coaxially arranged with respect to the hollow body of said one of the first and second current path section, said one of the first and second current path section comprising a first current path section member and at least one second current path section member arranged in spaced relation to an outer surface of the first current path section member and being electrically coupled with the first current path section member via at least a first coupling surface portion of said outer surface of the first current path section member.

10. A circuit breaker connectable to an electrical circuit, the circuit breaker comprising:

a first current path section and a second current path section, each of the first and second current path section comprising a respective first end and a respective second end, each of the first and second current path section being connectable to the electrical circuit at the respective first end; and a circuit breaker module adapted to at least momentarily controllably discontinue flow of electrical current in the electrical circuit by at least momentarily controllably discontinuing flow of electrical current through the circuit breaker module, each of the first and second current path section being connectable to the circuit breaker module at the respective second end;

wherein each of the first and second current path section comprises:

a first current path section member; and at least one second current path section member arranged in spaced relation to a surface of the first current path section member and being electrically coupled with the first current path section member via at least a first coupling surface portion of said surface of the first current path section member;

wherein each of the first current path section and the at least one second current path section extends along a longitudinal direction, and wherein at least one of the first current path section member and the at least one second current path member comprises a plurality of elongated bodies extending along the longitudinal direction.

11. The circuit breaker according to claim 10, wherein the plurality of elongated bodies are circumferentially spaced about a boundary of the second end of the respective one of the first and second current path section.

12. The circuit breaker according to claim 1, wherein at least one of the first current path section member and the at least one second current path section member comprises a plurality of through-holes.

13. A switchgear comprising a circuit breaker, said circuit breaker connectable to an electrical circuit, the circuit breaker comprising:

a first current path section and a second current path section, each of the first and second current path section comprising a respective first end and a respective second end, each of the first and second current path section being connectable to the electrical circuit at the respective first end; and a circuit breaker module adapted to at least momentarily controllably discontinue flow of electrical current in the electrical circuit by at least momentarily controllably discontinuing flow of electrical current through the circuit breaker module, each of the first and second current path section being connectable to the circuit breaker module at the respective second end;

wherein each of the first and second current path section comprises:

a first current path section member; and at least one second current path section member arranged in spaced relation to a surface of the first current path section member and being electrically coupled with the first current path section member via at least a first coupling surface portion of said surface of the first current path section member.

14. The circuit breaker according to claim 10 further comprising a switchgear to which the circuit breaker is connected.

15. The circuit breaker according to claim 10 further comprising an electrical power transmission system comprising an electrical circuit to which a circuit breaker is connected.

16. The circuit breaker according to claim 13 further comprising an electrical power transmission system comprising an electrical circuit to which a circuit breaker is connected.

* * * * *